US008215287B2

(12) United States Patent
Lee

(10) Patent No.: US 8,215,287 B2
(45) Date of Patent: Jul. 10, 2012

(54) FUEL SUPPLY APPARATUS FOR ENGINE AND INJECTOR FOR THE SAME

(75) Inventor: Taeseong Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 334 days.

(21) Appl. No.: 12/606,717

(22) Filed: Oct. 27, 2009

(65) Prior Publication Data

US 2010/0132669 A1 Jun. 3, 2010

(30) Foreign Application Priority Data

Dec. 3, 2008 (KR) ..... 10-2008-0121812

(51) Int. Cl.
*F02M 69/46* (2006.01)
*F02M 59/36* (2006.01)

(52) U.S. Cl. ..... 123/456; 123/458

(58) Field of Classification Search ..... 123/456, 123/457, 458, 468, 469; 251/129.09, 129.1, 251/129.21, 129.22; 239/585.1–585.3
See application file for complete search history.

(56) References Cited

U.S. PATENT DOCUMENTS

| | | | | |
|---|---|---|---|---|
| 4,176,687 | A * | 12/1979 | Ensign | 137/625.65 |
| 5,642,714 | A * | 7/1997 | Buckley | 123/447 |
| 5,727,525 | A * | 3/1998 | Tsuzuki | 123/447 |
| 5,732,679 | A * | 3/1998 | Takahasi et al. | 123/467 |
| 6,053,421 | A * | 4/2000 | Chockley | 239/5 |
| 6,092,509 | A * | 7/2000 | Tanabe et al. | 123/447 |
| 6,170,524 | B1 * | 1/2001 | Gray, Jr. | 137/625.18 |
| 6,520,152 | B1 * | 2/2003 | Mahr et al. | 123/447 |
| 6,619,263 | B1 * | 9/2003 | Otterbach et al. | 123/447 |
| 6,739,293 | B2 * | 5/2004 | Turner et al. | 123/90.12 |
| 6,895,937 | B2 * | 5/2005 | Namekawa et al. | 123/447 |
| 6,973,921 | B2 * | 12/2005 | Shafer et al. | 123/495 |
| 7,146,963 | B2 * | 12/2006 | Tahara | 123/431 |
| 7,150,268 | B2 * | 12/2006 | Shafer et al. | 123/446 |
| 7,431,017 | B2 * | 10/2008 | Gibson | 123/446 |
| 2002/0002964 | A1 | 1/2002 | Kohketsu et al. | |
| 2004/0168673 | A1 * | 9/2004 | Shinogle | 123/456 |
| 2005/0115544 | A1 * | 6/2005 | Kim | 123/456 |
| 2007/0101968 | A1 * | 5/2007 | Gibson et al. | 123/300 |

FOREIGN PATENT DOCUMENTS

| | | | |
|---|---|---|---|
| JP | 8-68368 | A | 3/1996 |
| JP | 9-96263 | A | 4/1997 |
| JP | 10-148166 | A | 6/1998 |
| JP | 11-218066 | A | 8/1999 |
| JP | 2002-349330 | A | 12/2002 |
| JP | 2007-205330 | A | 8/2007 |
| KR | 2002-0069263 | A | 8/2002 |
| KR | 10-2005-0038901 | A | 4/2005 |
| KR | 10-0774835 | B1 | 11/2007 |

* cited by examiner

*Primary Examiner* — Thomas Moulis
(74) *Attorney, Agent, or Firm* — Morgan, Lewis & Bockius LLP

(57) ABSTRACT

A fuel supply apparatus for an engine may include a plurality of common rails that stores fuel under relatively different pressures, and at least an injector that is connected to the common rails to be independently supplied with the fuel and selectively inject the fuel in any one of the connected common rails.

13 Claims, 7 Drawing Sheets

FUEL SUPPLY APPARATUS FOR ENGINE AND INJECTOR FOR THE SAME

CROSS-REFERENCE TO RELATED APPLICATIONS

The present application claims priority to Korean Application Serial Number 10-2008-0121812, filed on Dec. 3, 2008, the entire contents of which are incorporated herein for all purposes by this reference.

BACKGROUND OF THE INVENTION

1. Field of the Invention

The present invention relates to a fuel supply apparatus for an engine and an injector for the same, particularly a technology about a common rail type fuel supply apparatus that stores high pressure fuel in a common rail and supplies the fuel to each combustion chamber using a plurality of injectors connected to the common rail.

2. Description of Related Art

FIG. 1 shows a general common rail type engine fuel supply apparatus in the related art, in which fuel compressed by a high pressure pump 500 is stored in one common rail 502 under high pressure and the stored fuel can be injected through a plurality of injectors 504 connected to common rail 502 by operations of solenoids.

However, the fuel supply apparatus including common rail 502 has a limit in optimizing the injection conditions because the fuel pressure of common rail 502 is constant in the same injection cycle and the injection pressure cannot be differently adjusted, if needed.

That is, pilot injection or post injection before or after main injection cannot be performed at appropriate pressure according to requirements of the engine, such that it is difficult to achieve various types of injection.

For reference, an injection pressure pattern of fuel that can be achieved by the fuel supply apparatus is exemplified at the lower portion of FIG. 1.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a fuel supply apparatus for an engine and an injector for the apparatus that makes it possible to implement various and optimal types of fuel injection and to improve combustion performance of an engine by making it possible to appropriately injecting fuel in various combinations of injection pressure according to requirements of the engine.

In an aspect of the present invention, the fuel supply apparatus for an engine may include a plurality of common rails that stores fuel under relatively different pressures, and at least an injector that is connected to the common rails to be independently supplied with the fuel and selectively inject the fuel in any one of the connected common rails.

The common rails may include a high pressure common rail connected to a pressure pump and a low pressure common rail connected to the high pressure common rail through a passage, a high pressure control valve is disposed in the passage and controllable, and a low pressure control valve is disposed in a return passage connecting the low pressure common rail to a fuel tank and controllable.

In another aspect of the present invention, the fuel supply apparatus for an engine may further include a spill passage connecting the injectors to the return passage, wherein the low pressure control valve is disposed upstream the spill passage in the return passage.

The injectors may be connected to the high pressure common rail and the low pressure common rail to be supplied with the fuel.

In further another aspect of the present invention, the injector may include a housing, a high pressure port formed in the housing and connected with the high pressure common rail, a low pressure port connected to the low pressure common rail, a spill port returning the fuel to the fuel tank through the spill passage, and a valve member received in the housing and controlling communication between the low pressure port with an injection nozzle, communication between the high pressure port with the injection nozzle, and communication between the injection nozzle with the spill port.

The valve member may include a low pressure spool slidable in the housing and having a first low pressure channel that is formed to selectively communicate the low pressure port with the spill port and a second low pressure channel that is formed to communicate the first low pressure channel with the injection nozzle, a high pressure spool slidable in the housing and having a first high pressure channel that is formed to selectively communicate the high pressure port with the spill port and a second high pressure channel to selectively communicate from the first high pressure channel toward the injection nozzle, a first actuator controlling a sliding motion of the low pressure spool in the housing, a second actuator controlling a sliding motion of the high pressure spool in the housing, an intermediate spool of which one end is configured to selectively contact with the low pressure spool to close the second low pressure channel, and of which the other end is engaged with the high pressure spool, the intermediate spool having a constant-communicated channel at the other end thereof to selectively communicate from the second high pressure channel toward the injection nozzle according to the sliding motion of the high pressure spool, a first elastic member that is disposed between the first actuator and the low pressure spool, and a second elastic member that is disposed between the second actuator and the high pressure spool.

The first low pressure channel may be formed in a perpendicular direction to a straight sliding direction of the low pressure spool, the second low pressure channel may be formed in the straight sliding direction of the low pressure spool toward the high pressure spool, and the first high pressure channel may be formed in a perpendicular direction to a straight sliding direction of the high pressure spool and the second high pressure channel may be formed in the straight sliding direction of the high pressure spool toward the low pressure spool.

The other end of the intermediate spool may be integrally fixed to the high pressure spool.

The first and second actuators may be solenoids.

The fuel supply apparatus for an engine may further include a high pressure connection channel formed in the housing to connect the constant-communicated channel with the injection nozzle and including a one-way valve to permit one flow direction of the fuel from the constant-communicated channel toward the injection nozzle, wherein the injection nozzle is connected to a first space defined between the first actuator and the low pressure spool through a low pressure connection channel formed in the housing, and to a second space defined between the second actuator and the high pressure spool through the high pressure connection channel, and the one-way valve is opened only toward the injection nozzle from the second space.

In various aspects, the present invention as a common rail type makes it possible to implement various and optimal types of fuel injection and to improve combustion performance of an engine by making it possible to appropriately injecting fuel in various combinations of injection pressure according to requirements of the engine.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
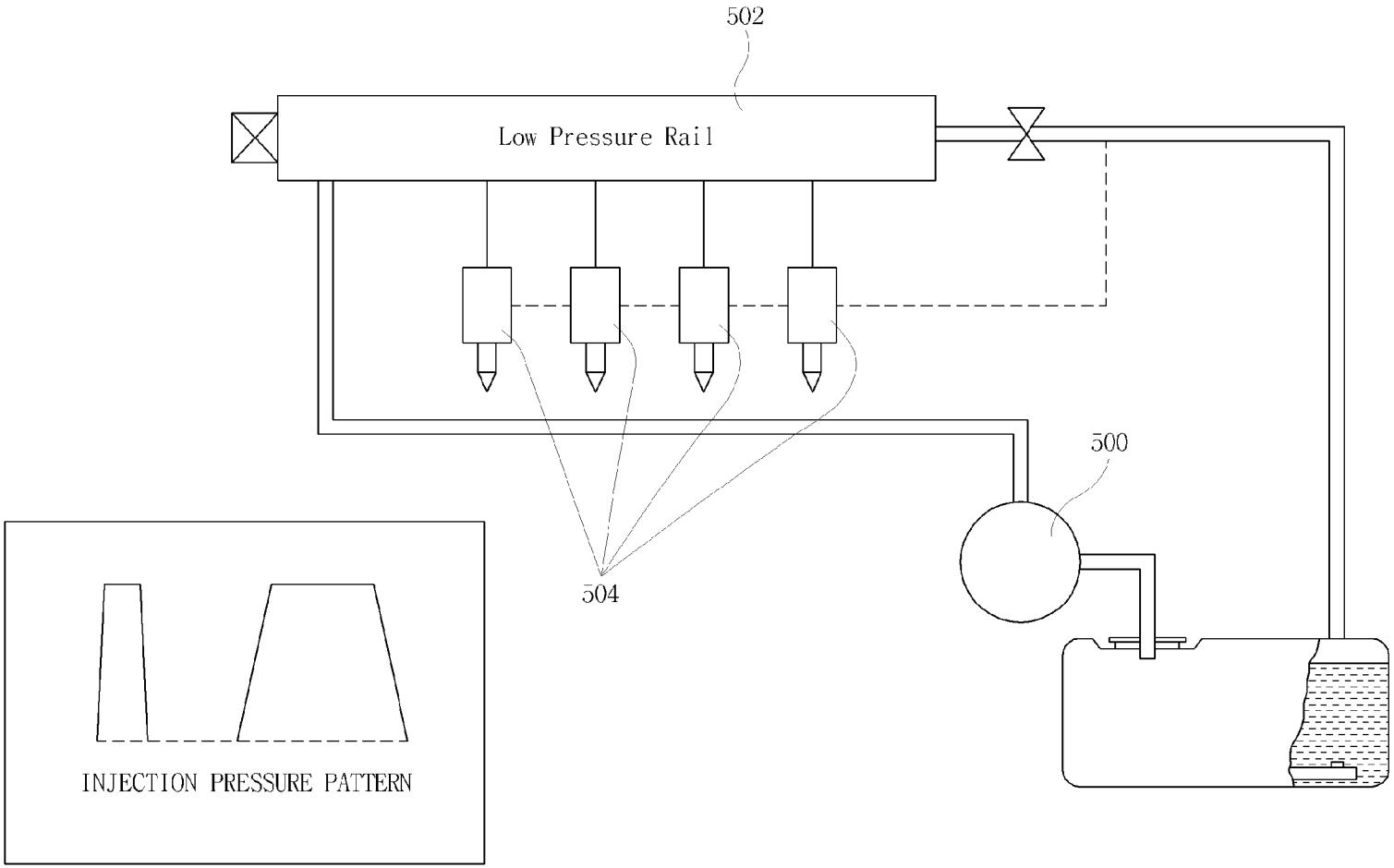
FIG.1 (Prior Art)
FIG. 1 is a view showing an example of a fuel supply apparatus for an engine according to the related art.
Figure 2:
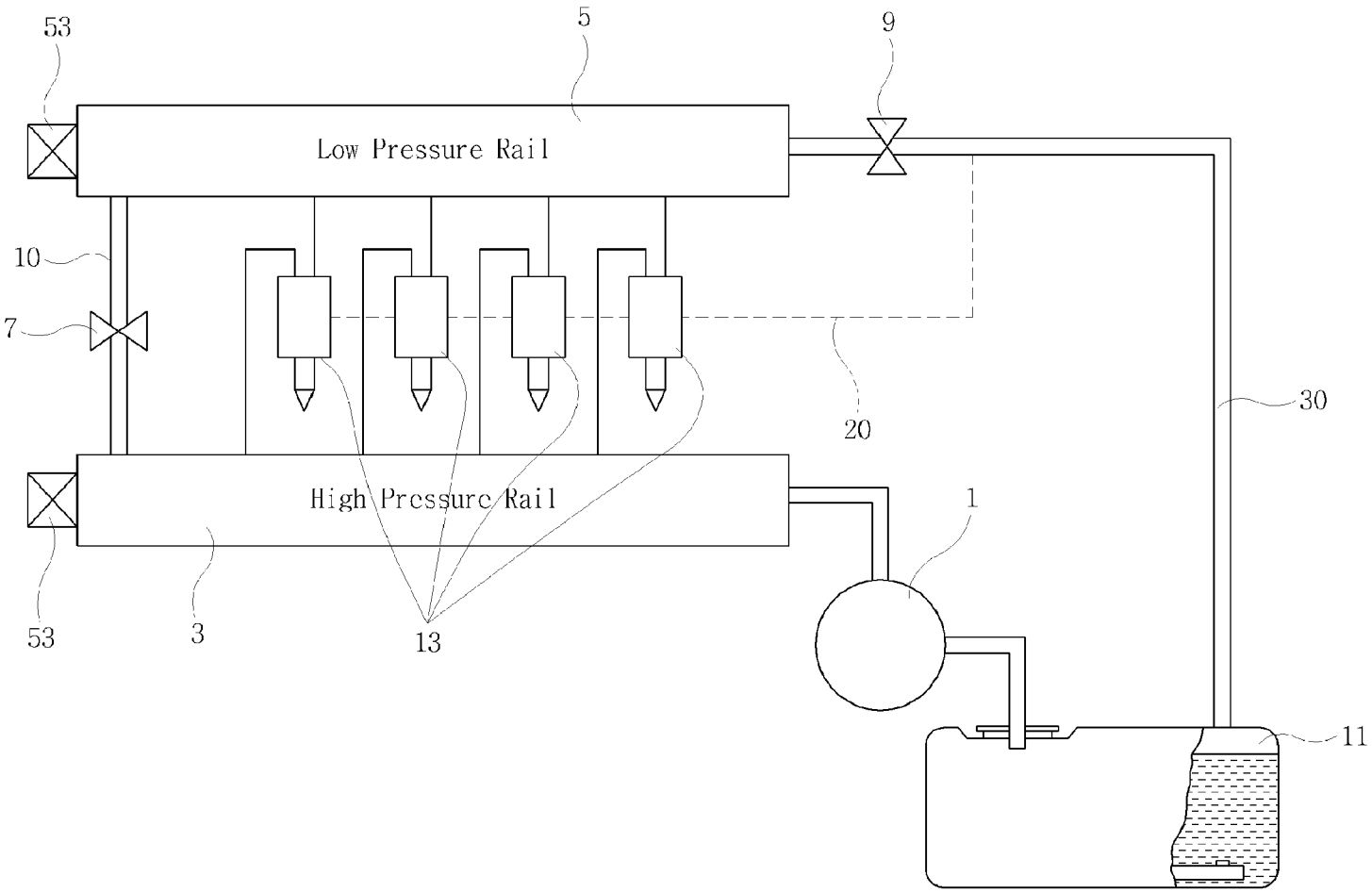
FIG. 2 is a view showing an embodiment of a fuel supply apparatus for an engine according to an exemplary embodiment of the present invention.
Figure 3:
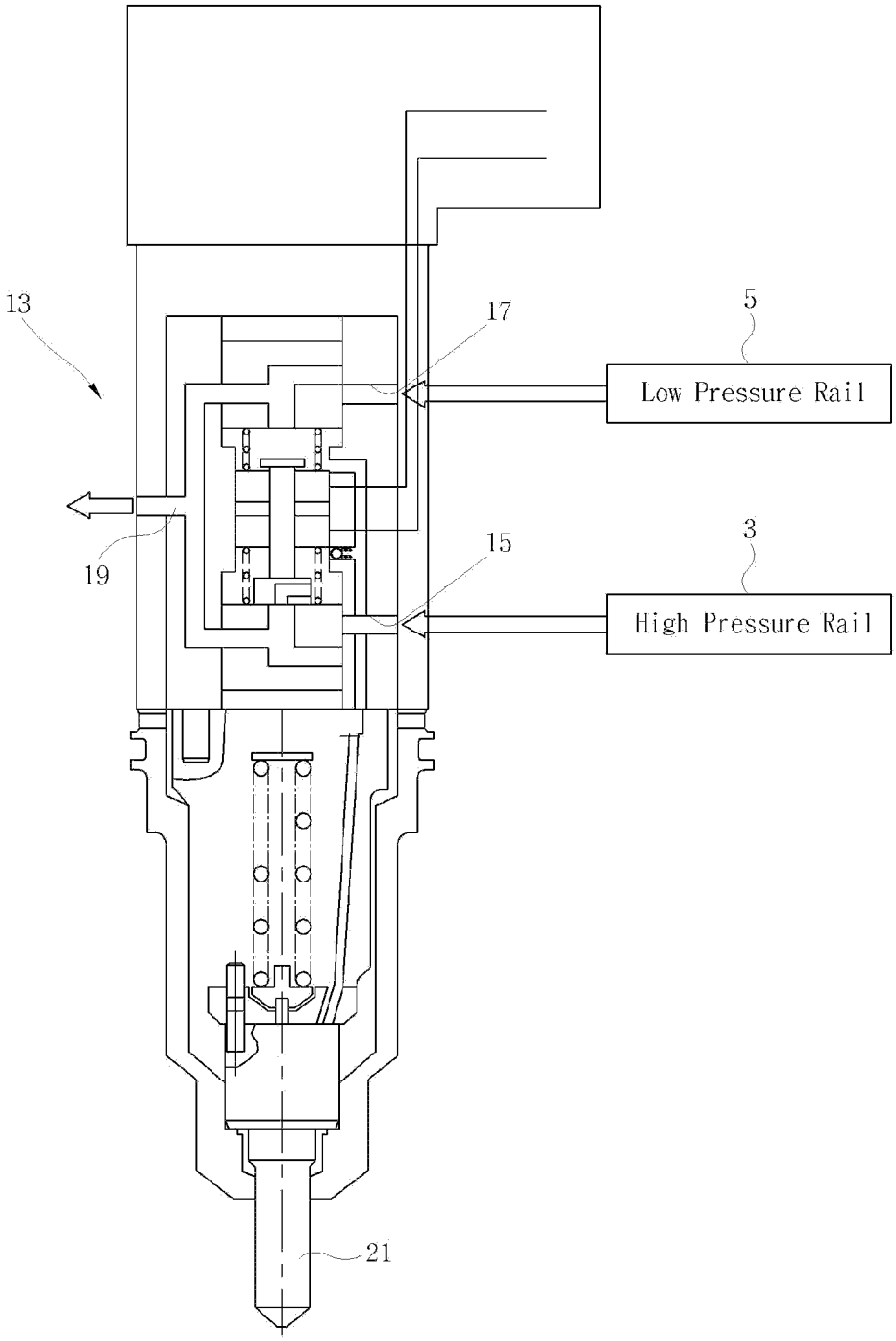
FIG. 3 is a view showing an embodiment of an injector according to an exemplary embodiment of the present invention.
Figure 4:
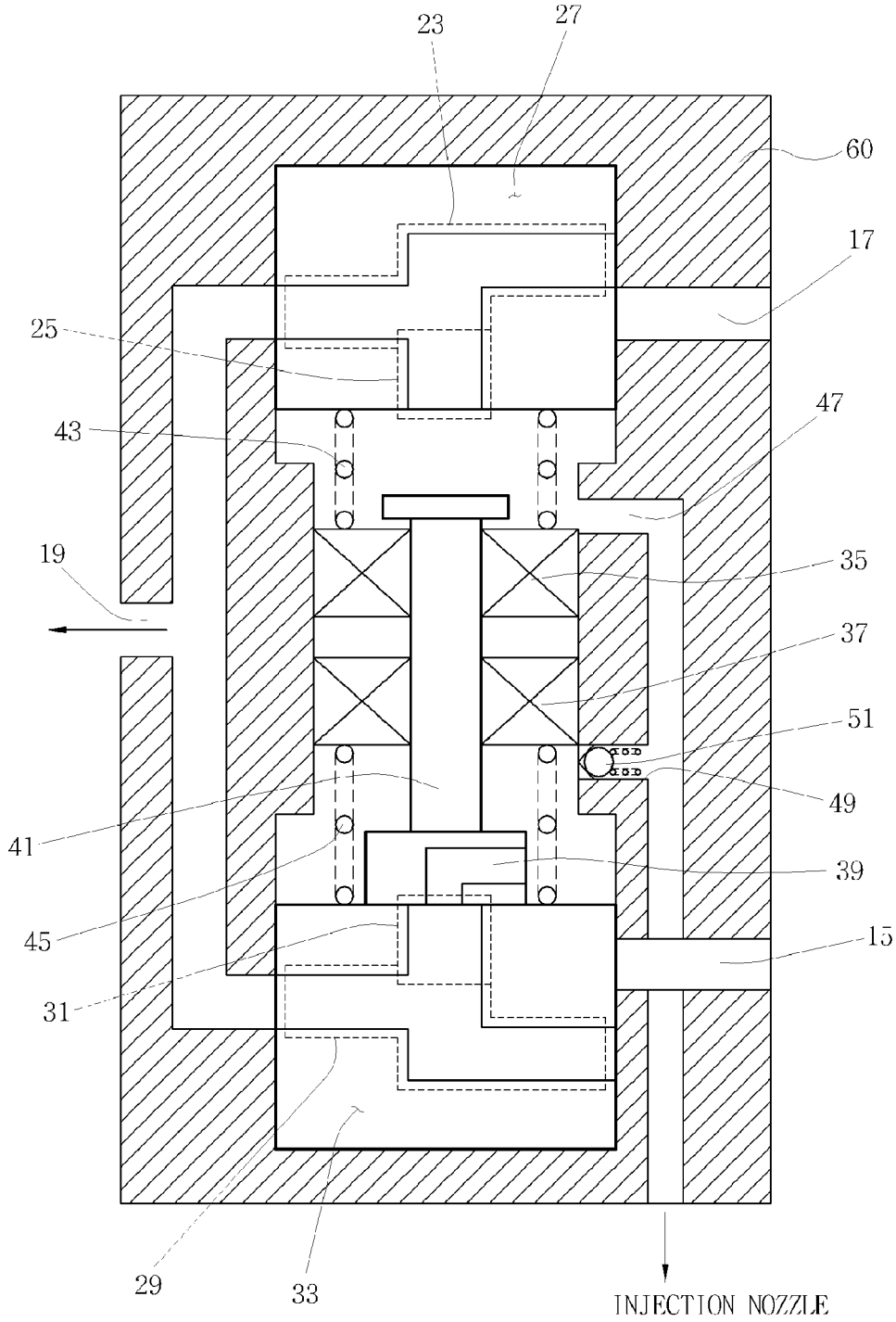
FIG. 4 is a view showing the main parts of FIG. 3 in detail.

Referring to FIG. 2 to 4, a fuel supply apparatus for an engine according to an exemplary embodiment of the present invention includes at least two or more common rails that stores fuel under relatively different pressures, and a plurality of injectors 13 that is connected to the common rails to be independently supplied with the fuel and selectively inject fuel in any one of the connected common rails.

In this exemplary embodiment, the common rails are composed of a high pressure common rail 3 connected to a high pressure pump 1 and a low pressure common rail 5 connected to high pressure common rail 3, a high pressure control valve 7 is disposed in a passage 10 connecting high pressure common rail 3 and low pressure common rail 5 and a low pressure control valve 9 is disposed between low pressure common rail 5 and a fuel tank 11.

High pressure common rail 3 and low pressure common rail 5 are, as shown in the figure, each provided with a pressure sensor 53 to sense pressure state required to control high pressure control valve 7 and low pressure control valve 9.

High pressure control valve 7, low pressure control valve 9, and pressure sensors 53 are connected to a controller, which is not shown.

As high pressure pump 1 supplies fuel to high pressure common rail 3 by pumping up the fuel, high pressure common rail 3 controls the fuel at predetermined high pressure that should be maintained in high pressure common rail 3 by using high pressure control valve 7 and passes the other fuel to low pressure common rail 5, and low pressure common rail 5 controls and maintains the supplied fuel at relatively low pressure by using low pressure control valve 9 and returns the other fuel to fuel tank 11 via a return passage 30.

Injectors 13 for the fuel supply apparatus are connected to high pressure common rail 3 and low pressure common rail 5 to be supplied with the fuel in this exemplary embodiment.

Injector 13 includes a high pressure port 15 connected with high pressure common rail 3, a low pressure port 17 connected to low pressure common rail 5, and a spill port 19 connected to a spill passage 20 returning the fuel to fuel tank 11, and a valve member that changes states of closing/communicating low pressure port 17 from/with an injection nozzle 21, states of closing/communicating high pressure port 15 from/with injection nozzle 21, and a state of communicating injection nozzle 21 with spill port 19.

Spill port 19 is connected between low pressure control valve 9 and fuel tank 11, as indicated by a dotted line in FIG. 2.

The valve member in this exemplary embodiment includes: a housing 60, a low pressure spool 27 having a first low pressure channel 23 that is formed such that both ends may be communicated with low pressure port 17 and spill port 19, respectively, in the perpendicular direction to a straight sliding direction, and a second low pressure channel 25 that is formed in the straight sliding direction to communicate first low pressure channel 23 with injection nozzle 21; a high pressure spool 33 sliding while facing low pressure spool 27, and having a first high pressure channel 29 that is formed such that both ends may be communicated with high pressure port 15 and spill port 19, respectively, in the perpendicular direction to the straight sliding direction, and a second high pressure channel 31 that is formed toward low pressure spool 27 to selectively communicate from first high pressure channel 29 to injection nozzle 21; a low pressure solenoid 35 and a high pressure solenoid 37 that are disposed between high pressure spool 33 and low pressure spool 27 to pull low pressure spool 27 toward high pressure spool 33 and pull high pressure spool 33 toward low pressure spool 27, respectively; an intermediate spool 41 of which one end selectively contacts the low pressure spool 27 to close second low pressure channel 25 and the other end is engaged with the high pressure spool 33 and has a constant-communicated channel 39 to communicate from second high pressure channel 31 toward injection nozzle 21 even if the other end is in close contact with high pressure spool 33; a low pressure-sided spring 43 that is disposed between low pressure solenoid 35 and low pressure spool 27; and a high pressure-sided spring 45 that is disposed between high pressure solenoid 37 and high pressure spool 33.

Injection nozzle 21 is connected to a space defined between low pressure solenoid 35 and low pressure spool 27 through a low pressure connection channel 47, to a space defined between high pressure solenoid 37 and high pressure spool 33 through a high pressure connection channel 49, and high pressure connection channel 49 is further provided with a check valve 51 that is opened only toward injection nozzle 21 from the space between high pressure solenoid 37 and high pressure spool 33.

Figure 5:
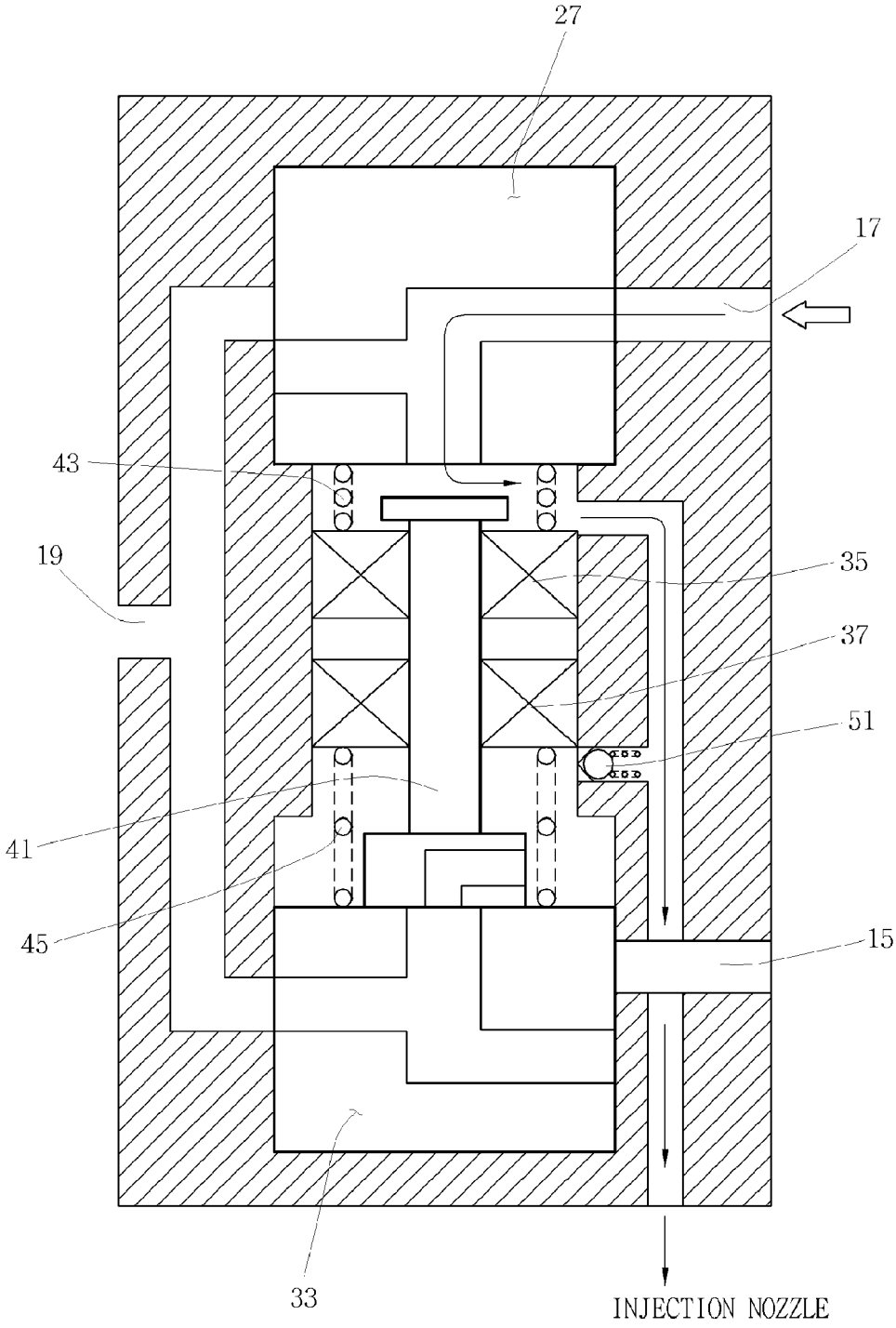
FIG. 5 is a view illustrating when fuel is supplied from a low pressure port to an injection nozzle.
Figure 6:
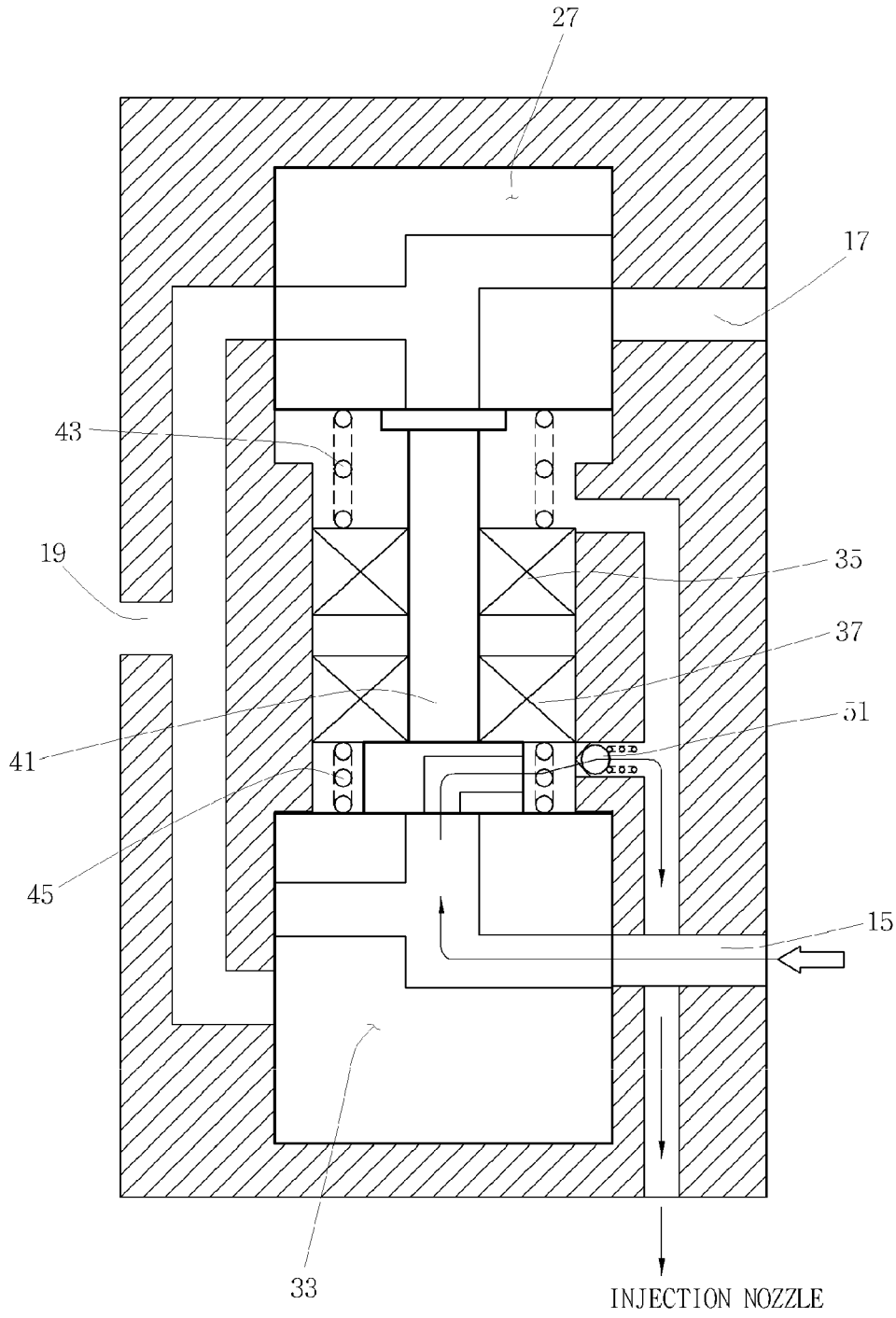
FIG. 6 is a view illustrating when fuel is supplied from a high pressure port to an injection nozzle.

FIG. 4 shows a neutral state in which high pressure common rail 3 or low pressure common rail 5 is not connected to injection nozzle 21 of injector 13 but the injection nozzle is communicated with spill port 19 so as to return the fuel to the fuel tank 11 through the spill passage 20, and this state can be converted into a state in which the fuel in low pressure common rail 5 is supplied to injection nozzle 21 by operation of low pressure solenoid 35 or high pressure solenoid 37 as shown in FIG. 5, or the fuel in high pressure common rail 3 is supplied to injection nozzle 21 as shown in FIG. 6.

First, in the state of supplying the fuel in low pressure common rail 5 to injection nozzle 21, as power is supplied to low pressure solenoid 35 and low pressure spool 27 is pulled down in the state shown in FIG. 4, low pressure port 17 is communicated with injection nozzle 21 through first low pressure channel 23 and second low pressure channel 25, and the fuel supplied through low pressure port 17 is supplied to injection nozzle 21, such that the fuel is injected at low pressure.

In this operation, high pressure spool 33 closes high pressure port 15 and check valve 51 disposed in high pressure connection channel 49 closes the channel connected to between injection nozzle 21 and spill port 19 such that the fuel flowing from low pressure port 17 to injection nozzle 21 does not leak to spill port 19.

FIG. 6 shows a state when power is supplied only to high pressure solenoid 37, in which as high pressure solenoid 37 moves upward, intermediate spool 41 closes second low pressure channel 25 of low pressure spool 27 while moving upward such that fuel does not leak out of injection nozzle 21 to spill port 19.

Further, high pressure spool 33 reaches a position where it can supply fuel from high pressure port 15 into the space between high pressure spool 33 and high pressure solenoid 37 through first high pressure channel 29 and second high pressure channel 31, and the high pressure fuel between high pressure spool 33 and high pressure solenoid 37 passes through check valve 51 and supplied to injection nozzle 21 to be injected at high pressure.

When power is cut to both of low pressure solenoid 35 and high pressure solenoid 37, low pressure spool 27, high pressure spool 33, and intermediate spool 41 are returned to the positions shown in FIG. 4 by high pressure-sided spring 45 and low pressure-sided spring 43, thereby removing the pressure exerted in injection nozzle 21.

For reference, the 'high pressure' and 'low pressure' were used herein as relative conceptions.

Figure 7:
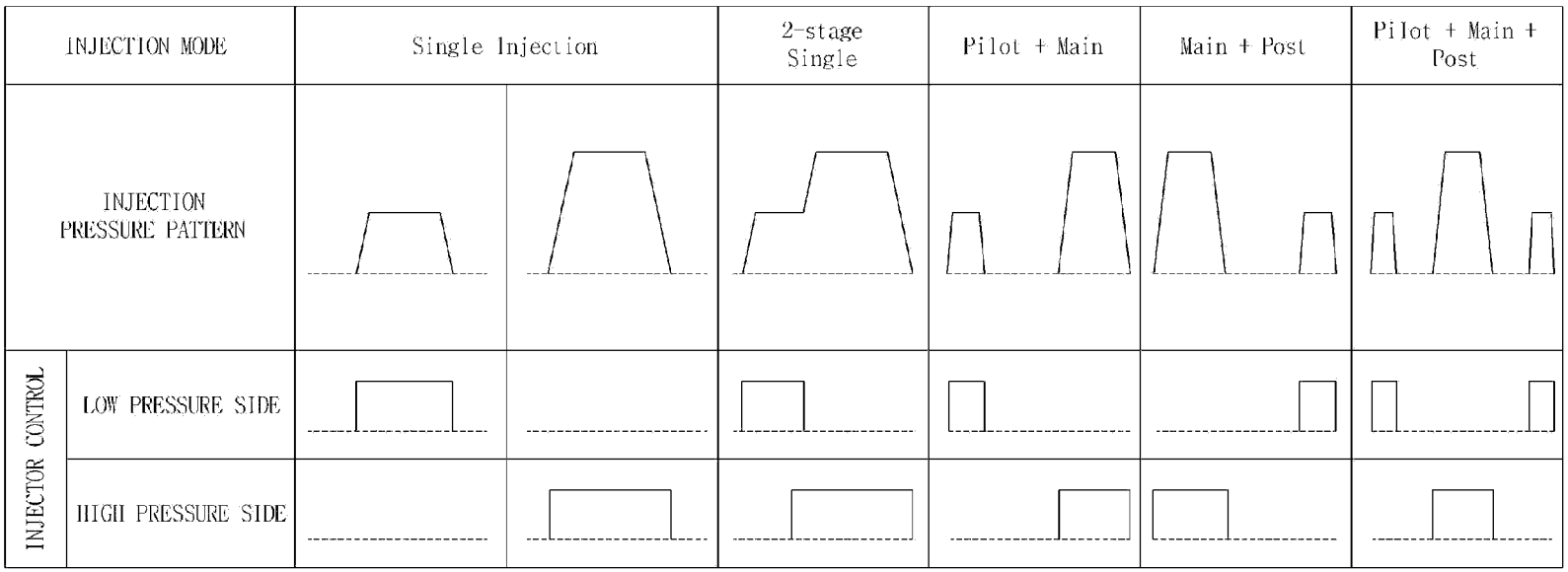
FIG. 7 is a view showing a portion of injection types that can be achieved by the present invention.

It is possible to implement various types on injection, as shown in FIG. 7, by using a fuel supply apparatus for an engine having the above configuration and injectors 13 for the apparatus.

That is, it is possible to implement single injection only by using the fuel in low pressure common rail 5 or the fuel in high pressure common rail 3. Further, it is possible to implement 2-state single injection, which is one injection connected with low pressure and high pressure, and to achieve various combinations of pilot injection before main injection and post injection after the main injection at relatively appropriately low pressure.

It should be understood that various combinations other than those show in FIG. 7 can be implemented.

Since it is possible to freely implement various types of injection by selectively combining high pressure and low pressure fuels in a single injector 13, it is possible to improve the output of the engine and reduce noxious exhaust gas by achieving optimal fuel supply state corresponding to the conditions of the combustion chamber of the engine to implement smooth combustion.

For convenience in explanation and accurate definition in the appended claims, the terms "lower," "high," and "low" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A fuel supply apparatus for an engine comprising:

a plurality of common rails that stores fuel under relatively different pressures; and at least an injector that is connected to the common rails to be independently supplied with the fuel and selectively inject the fuel in any one of the connected common rails;

wherein the common rails include a high pressure common rail connected to a pressure pump and a low pressure common rail connected to the high pressure common rail through a passage;

wherein a high pressure control valve is disposed in the passage and controllable;

wherein a low pressure control valve is disposed in a return passage connecting the low pressure common rail to a fuel tank and controllable; and wherein the injectors are connected to the high pressure common rail and the low pressure common rail to be supplied with the fuel;

wherein the injector includes:

a housing;

a high pressure port formed in the housing and connected with the high pressure common rail;

a low pressure port connected to the low pressure common rail;

a spill port returning the fuel to the fuel tank through the spill passage; and a valve member received in the housing and controlling communication between the low pressure port and an injection nozzle, communication between the high pressure port and the injection nozzle, and communication between the injection nozzle and the spill port, wherein the valve member includes:

a low pressure spool slidable in the housing and having a first low pressure channel that is formed to selectively communicate the low pressure port with the spill port and a second low pressure channel that is formed to communicate the first low pressure channel with the injection nozzle;

a high pressure spool slidable in the housing and having a first high pressure channel that is formed to selectively communicate the high pressure port with the spill port and a second high pressure channel to selectively communicate from the first high pressure channel toward the injection nozzle;

a first actuator controlling a sliding motion of the low pressure spool in the housing;

a second actuator controlling a sliding motion of the high pressure spool in the housing;

an intermediate spool of which one end is configured to selectively contact with the low pressure spool to close the second low pressure channel, and of which the other end is engaged with the high pressure spool, the intermediate spool having a constant-communicated channel at the other end thereof to selectively communicate from the second high pressure channel toward the injection nozzle according to the sliding motion of the high pressure spool;

a first elastic member that is disposed between the first actuator and the low pressure spool; and a second elastic member that is disposed between the second actuator and the high pressure spool.

2. The fuel supply apparatus for an engine as defined in claim 1, further includes a spill passage connecting the injectors to the return passage.

3. The fuel supply apparatus for an engine as defined in claim 2, wherein the low pressure control valve is disposed upstream the spill passage in the return passage.

4. The fuel supply apparatus for an engine as defined in claim 1, wherein the first low pressure channel is formed in a perpendicular direction to a straight sliding direction of the low pressure spool, the second low pressure channel is formed in the straight sliding direction of the low pressure spool toward the high pressure spool, and the first high pressure channel is formed in a perpendicular direction to a straight sliding direction of the high pressure spool and the second high pressure channel is formed in the straight sliding direction of the high pressure spool toward the low pressure spool.

5. The fuel supply apparatus for an engine as defined in claim 1, wherein the other end of the intermediate spool is integrally fixed to the high pressure spool.

6. The fuel supply apparatus for an engine as defined in claim 1, wherein the first and second actuators are solenoids.

7. The fuel supply apparatus for an engine as defined in claim 1, further including a high pressure connection channel formed in the housing to connect the constant-communicated channel with the injection nozzle and including a one-way valve to permit one flow direction of the fuel from the constant-communicated channel toward the injection nozzle.

8. The fuel supply apparatus for an engine as defined in claim 7, wherein the injection nozzle is connected to a first space defined between the first actuator and the low pressure spool through a low pressure connection channel formed in the housing, and to a second space defined between the second actuator and the high pressure spool through the high pressure connection channel, and the one-way valve is opened only toward the injection nozzle from the second space.

9. An injector comprising:

a housing;

a high pressure port formed in the housing and connected with a high pressure common rail, a low pressure port connected to a low pressure common rail, and a spill port returning the fuel to the fuel tank; and a valve member received in the housing and changing states of closing/communicating the low pressure port from/with an injection nozzle, states of closing/communicating the high pressure port from/with the injection nozzle, and a state of communicating the injection nozzle with the spill port, wherein the valve member includes:

a low pressure spool having a first low pressure channel that is formed such that both ends are selectively communicated with the low pressure port and the spill port in a perpendicular direction to a straight sliding direction of the low pressure spool, and a second low pressure channel that is formed in the straight sliding direction to communicate the first low pressure channel with the injection nozzle;

a high pressure spool sliding while facing the low pressure spool, and having a first high pressure channel that is formed such that both ends are selectively communicated with the high pressure port and the spill port, in a perpendicular direction to a straight sliding direction of the high pressure spool, and a second high pressure channel that is formed toward the low pressure spool to selectively communicate from the first high pressure channel toward the injection nozzle;

a low pressure actuator and a high pressure actuator that are disposed between the low pressure spool and the high pressure spool to selectively pull the low pressure spool toward the high pressure spool and selectively pull the high pressure spool toward the low pressure spool, respectively;

an intermediate spool of which one end selectively contacts with the low pressure spool to close the second low pressure channel, and of which the other end has a constant-communicated channel to selectively communicate from the second high pressure channel toward the injection nozzle even if the other end is in close contact with the high pressure spool;

a low pressure-sided elastic member that is disposed between the low pressure actuator and the low pressure spool; and a high pressure-sided elastic member that is disposed between the high pressure actuator and the high pressure spool.

10. The injector for an engine as defined in claim 9, wherein the other end of the intermediate spool is integrally fixed to the high pressure spool.

11. The injector for an engine as defined in claim 9, wherein the low pressure and high pressure actuators are solenoids.

12. The injector for an engine as defined in claim 9, further including a high pressure connection channel formed in the housing to connect the constant-communicated channel with the injection nozzle and including a one-way valve to permit one flow direction of the fuel from the constant-communicated channel toward the injection nozzle.

13. The injector for an engine as defined in claim 12, wherein the injection nozzle is connected to a first space defined between the low pressure actuator and the low pressure spool through a low pressure connection channel formed in the housing, and to a second space defined between the high pressure actuator and the high pressure spool through the high pressure connection channel, and the one-way valve is opened only toward the injection nozzle from the second space.

* * * * *